US005084321A

United States Patent [19]

Sui

[11] Patent Number: 5,084,321

[45] Date of Patent: Jan. 28, 1992

[54] DISPOSABLE TABLE CLOTH

[76] Inventor: Nien-Hsien Sui, 8, 20 Alley Kwan Ming Road, Mu-Jea District, Taipei, Taiwan

[21] Appl. No.: 425,132

[22] Filed: Oct. 23, 1989

[51] Int. Cl.[5] ..... A47B 13/08

[52] U.S. Cl. ..... 428/80; 428/99; 428/100; 428/81; 150/158

[58] Field of Search ..... 428/81, 100, 192, 80, 428/99; 150/158; 273/13; 52/3, 4

[56] References Cited

U.S. PATENT DOCUMENTS 3,623,526 11/1971 Robertson ..... 428/100

4,627,363 12/1986 Jones ..... 428/100

*Primary Examiner*—Alexander S. Thomas

*Attorney, Agent, or Firm*—Lowe, Price, LeBlanc & Becker

[57] ABSTRACT

A disposable table cloth includes a face having several extensions integrally extended therefrom with a VELCRO type hook and loop type fastener tape set one the front side or the back side of each extension, and having several elastic bands made on the corners of the face. When the table cloth is covered over a table, the extensions are turned into the bottom surface of the table face to let each pair of adjacent extensions be firmly attached by means of the hook and loop fastener tapes. The extensions of the face may be designed to have a forked end while a plurality of elastic bands are properly made on the face at a certain interval, so that the table cloth becomes practical for use to cover on a round, oval or any nonsquare table.

3 Claims, 3 Drawing Sheets

DISPOSABLE TABLE CLOTH

BACKGROUND OF THE INVENTION

The present invention is related to a kind of table cloth and particularly to one which is made of paper or plastic material, disposable, convenient in use, and inexpensive to manufacture.

Table cloth is a means served to protect a table against contamination and also to decorate the table. While playing bridge or other games over a table, or enjoying a picnic on a table, people may use a table cloth to cover the table. If a table cloth is not available, people may cover the table with paper, or plastic sheet or the like to protect the table. When a table cloth is contaminated, it is very difficult to fully clean the contaminated table cloth. If to throw regular table cloth away each time after use it is not economic. Although plastic sheet or paper is inexpensive, it is not graceful in appearance when used as a table cloth. In using either one of the said materials to cover a table, one may encounter some problems including <1> Difficult to smoothly set on the table; <2> Difficult to fix and easy to blow away by wind or lift by people due to inadvertance, to tip over the articles put thereon; <3> Difficult to handle after it is used; <4> Time-consuming in arrangement when covering over a table.

SUMMARY OF THE INVENTION

The present invention is to provide a kind of disposable table cloth which includes a face having a plurality of extensions integrally set at all lateral edges with VELCRO type hook and loop fastener tapes respectively set on the extensions and with elastic bands set at all angles. When the table cloth is covered over a table, the hook and loop fastener tapes of each two matching extensions of the table cloth are firmly attached together so as to let the table cloth be tightly stretched and smoothly attached to the table.

The features and advantages of the present invention will be fully understood from the following detailed description of the preferred embodiments considered in connection with the annexed drawings as hereunder.

DETAILED DESCRIPTION OF THE PREFERRED EMBODIMENTS

Figure 1A:
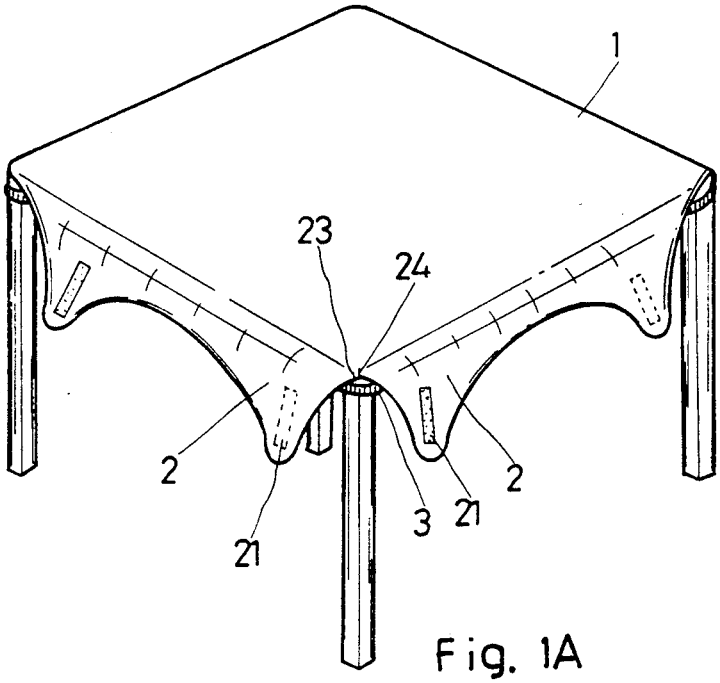
FIG. 1A-C are perspective drawings illustrating the application of an embodiment of the present invention to match with a square table.
Figure 1B:
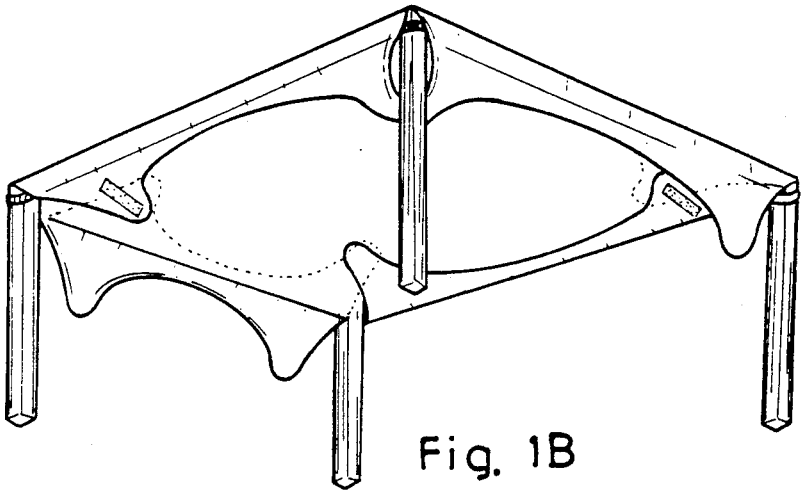
Figure 1C:
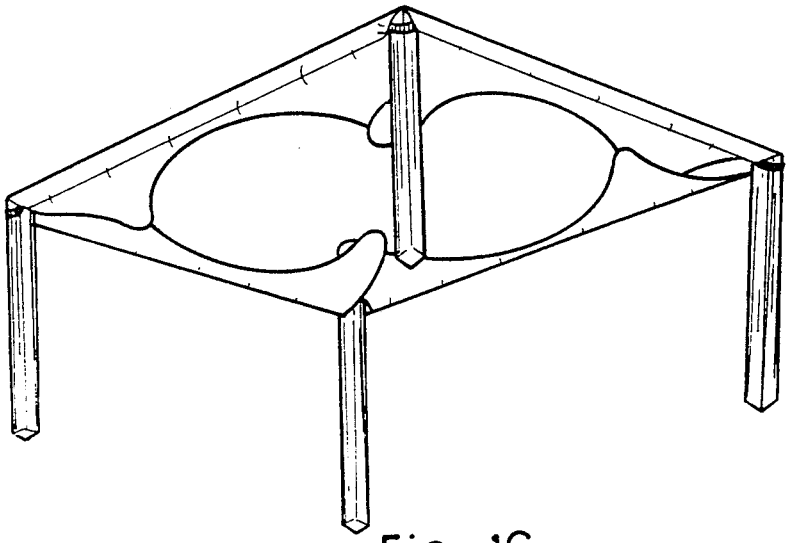
Figure 2:
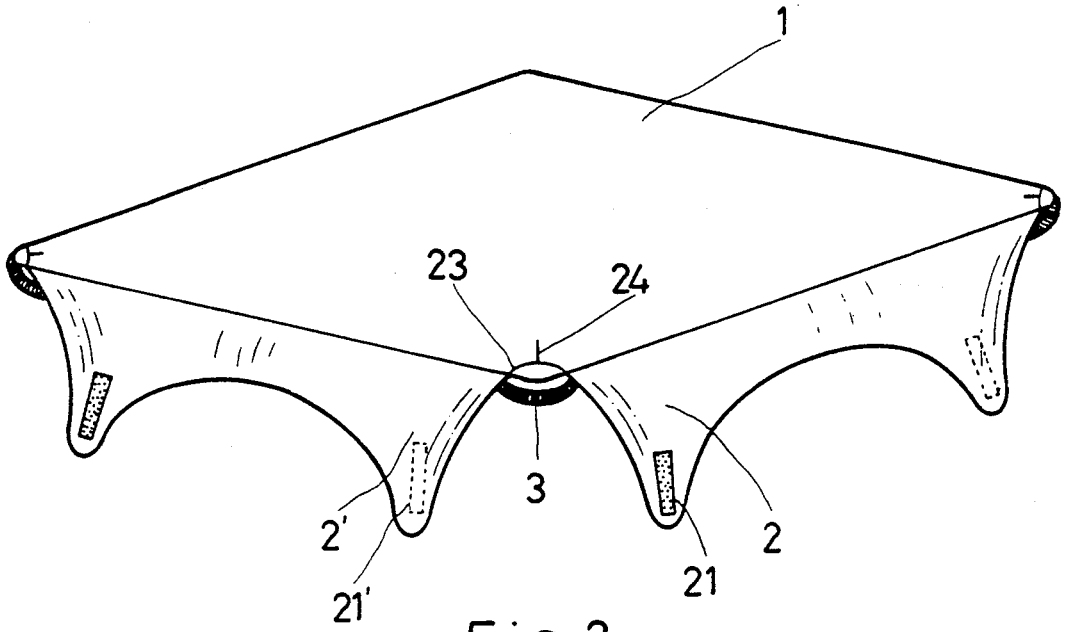
FIG. 2 illustrates the outer appearance of the present invention.
Figure 3:
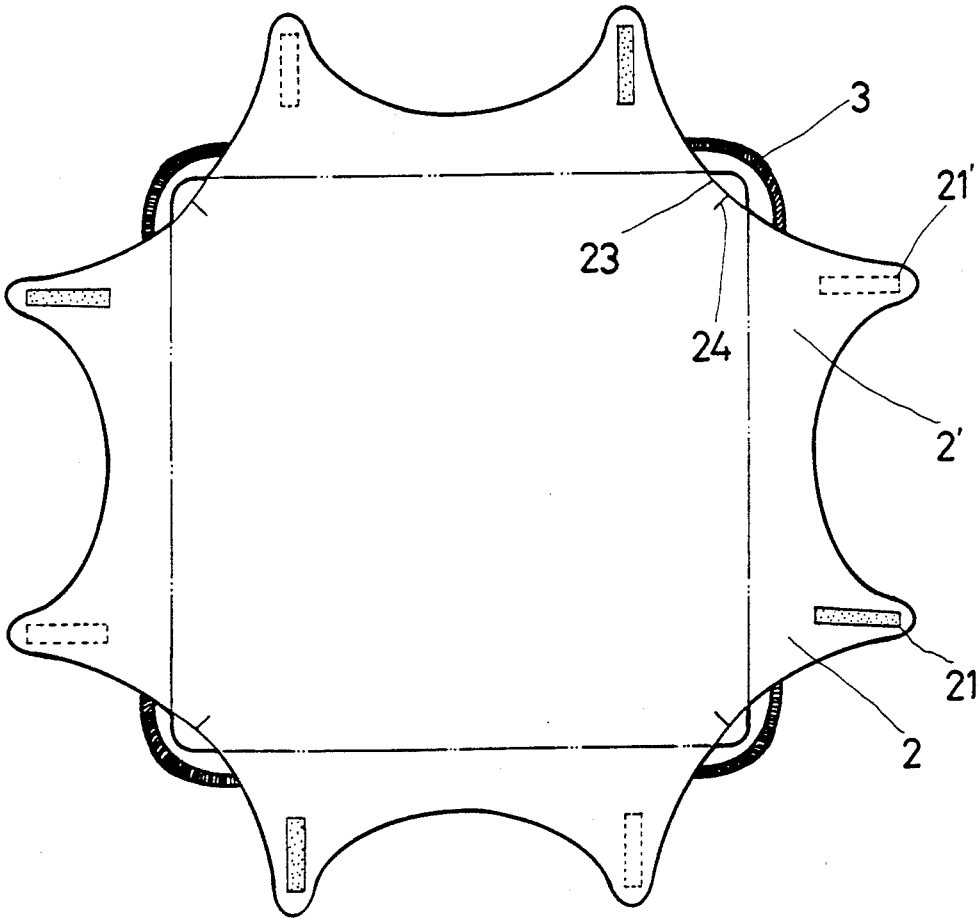
FIG. 3 is a schematic drawing, illustrating the present invention in an extended condition.

Referring to FIGS. 1 and 2, a disposable table cloth which is made of paper or plastic material is including a face (1) arranged in size large enough to fully cover the table face of regular table which may have a round, square, rectangular oval or any other shape. Two extensions (2) are integrally extended from the face (1) at each lateral side with a hook and loop fastener tape (21) respectively made thereon, which extensions (2) may be turned inward to cover over the back side of the table face. As shown in FIG. 1-C, when the extensions (2) are turned inward to cover over the back side of the table face, an extension (2) of one lateral side is set to lay on the adjacent extension (2)′ of another lateral side letting the respective tapes (21) and (21)′ be attached together so as to let the extensions be firmly retained to the bottom surface of the table face.

In order to stretch the face (1) and to let two corresponding extensions (2) and (2)′ be tightly combined when the table cloth is covered over a table, a plurality of elastic bands (3) are made on the face to respectively bridge each pair of matching extensions to match with the shape of table face corners.

Further, in order to fit for different size of table, the edge between each pair of matching extensions (2) and (2)′ is set to provide a curvature (23) bigger than the curved edge of each lateral side of the face (1), with a forked seam line made in the middle to let each pair of matching extensions (2) and (2)′ be flexibly turned inward to combined together at the bottom of the table.

Figure 4:
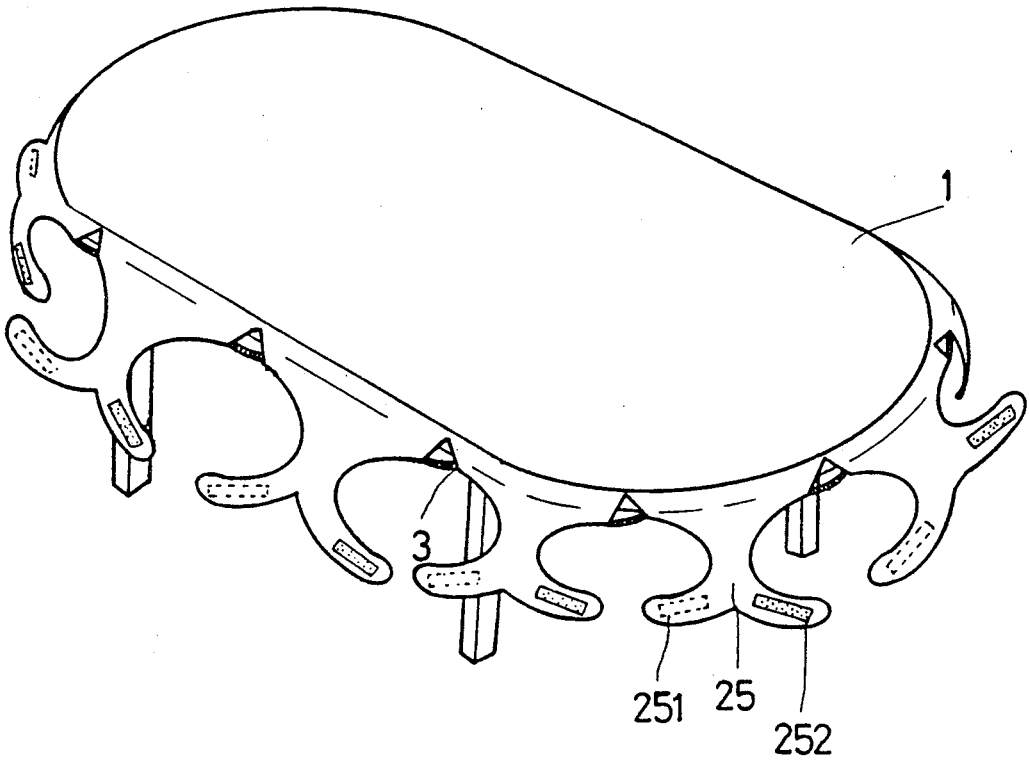
FIGS. 4 and 5 are perspective drawings of the present invention used to cover over a round table and an oval table respectively.
Figure 5:
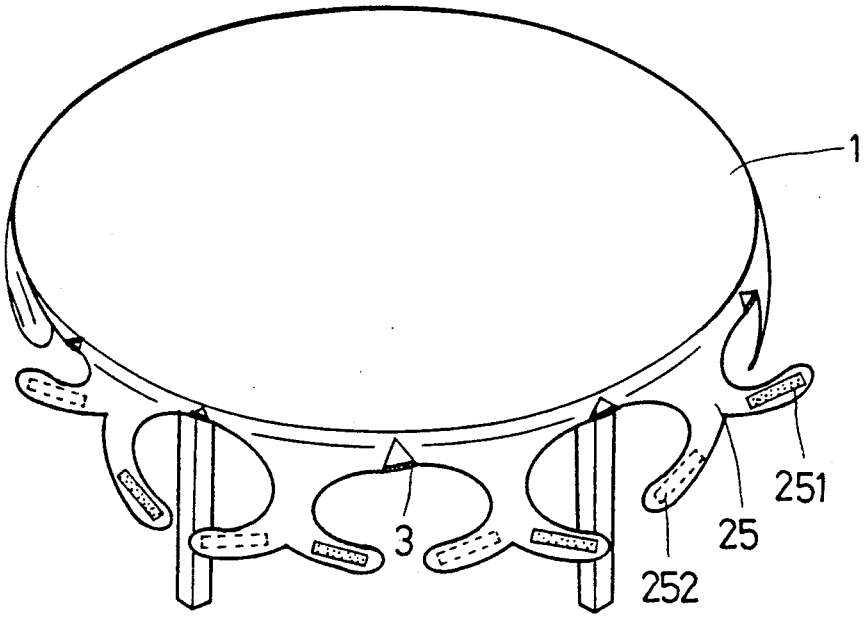

Please refer to the embodiment for oval and round table as shown in FIGS. 4 and 5, the face (1) is including a plurality of forked extensions (25) with hook and loop fastener tapes (251) and (252) respective made on each forked end, and a plurality of elastic bands (3) made the cuttings between each two forked extensions (25), such that the tapes (251) and (252) of a forked extension (25) are respectively stuck with the velcro tapes of adjacent forked extensions to stretch tight the face (1) when the table cloth is put on a table.

When to remove the table cloth from a table, the extensions (2) and (2)′ are separated from each other and the table cloth is conveniently picked up from the table.

I claim:

1. A disposable table cloth for covering square, rectangular or polygonal tables of different size, including a face having a plurality of lateral edges, mutually spaced adjacent pairs of curved extensions integrally extending around the lateral edges, a plurality of hook and loop fastener tapes mounted on said extensions, and a plurality of elastic bands mounted thereon to respectively bridge each adjacent pair of extensions to match with the shape of the table face corners, wherein said extensions are turned inward to let each adjacent pair of extensions be connected at the bottom of the table by means of the hook and loop fastener tapes, when the table cloth is covered over a table, so as to stretch tight the table cloth on the table face.

2. The disposable table cloth as set forth in claim 1, wherein the edge between each pair of adjacent extensions is set to provide a curvature bigger than the curved edge of each lateral side of the face, with a forked seam line made in the middle to let each pair of adjacent extensions be flexible turned inward to combined together at the bottom of any table in similar size.

3. A disposable table cloth according to claim 1, wherein the adjacent pairs of extensions are a plurality of pairs of forked extensions with hook and loop fastener tapes respective on each forked end, and one of said elastic bands being mounted between each pair of forked extensions.

* * * * *